US005263637A

United States Patent [19]

Simson

[11] Patent Number: 5,263,637

[45] Date of Patent: Nov. 23, 1993

[54] SELF-MAILER WITH RETURN ORDER ENVELOPE AND THE METHOD FOR PRODUCING THE SAME

[76] Inventor: Walter A. Simson, 230 Beverly Rd., Scarsdale, N.Y. 10583

[21] Appl. No.: 972,828

[22] Filed: Nov. 6, 1992

[51] Int. Cl.[5] ..... B65D 27/06

[52] U.S. Cl. ..... 229/304; 229/69; 493/187; 493/921

[58] Field of Search ..... 229/69, 300, 301, 303, 229/304; 493/187, 216, 921

[56] References Cited

U.S. PATENT DOCUMENTS

| | | | |
|---|---|---|---|
| 3,143,279 | 8/1964 | Black | 229/304 |
| 3,255,952 | 6/1966 | Black | 229/304 |
| 3,652,007 | 3/1972 | MacDougall | 229/304 |
| 3,941,309 | 3/1976 | Gendron | 229/301 |
| 4,102,489 | 7/1978 | Lucca | 229/304 |
| 4,543,082 | 9/1985 | Stenner | 493/921 X |
| 4,706,878 | 11/1987 | Lubotta et al. | 229/304 |

*Primary Examiner*—Allan N. Shoap

*Assistant Examiner*—Christopher McDonald

*Attorney, Agent, or Firm*—John Q. McQuillan

[57] ABSTRACT

The disclosure relates to the forming and printing of paper products, particularly paper products such as self-mailers, made from a moving web of paper which is printed on a continuous forms press and folded and glue sealed in one pass through a folder. The disclosed self-mailer includes a return order envelope. The self-mailer is printed on stock of a size and thickness to conform to postal regulations with both sides of the stock being printed, perforated on press to enable tear-off of the return portion of the self-mailer, scored to enable folding, and provided with a mailing window as a continuous form. Laser printing is used for subsequent application of an individual's name and address. The disclosure further relates to the provision of an additional panel separate from the self-mailer which is adapted to have the particulars of the addressee on the front side thereof, the reverse side of the additional panel is collated or plow folded and then glued to the reverse side of the first panel to form the pocket of a return envelope.

18 Claims, 4 Drawing Sheets

SELF-MAILER WITH RETURN ORDER ENVELOPE AND THE METHOD FOR PRODUCING THE SAME

BACKGROUND OF THE INVENTION

1. Field of the Invention

The present invention relates to the forming and printing of paper products, particularly paper products such as self-mailers having a return order envelope, made from a moving web of paper which is printed on a continuous forms press and folded and glue sealed in one pass through a folder.

In known systems for forming and printing sheet-like paper products such as self-mailers, printing is applied to both sides of the stock or web as it is advanced. Thereafter the stock or web is perforated and scored, followed by the application of glue. Printed personalization is then applied, i.e., printing of the name and address of the party to whom the self-mailer is to be sent.

SUMMARY OF THE INVENTION

In accordance with the present invention there is provided a printed paper product such as a self-mailer with a return order envelope. The self-mailer products are printed on stock of a size and thickness to conform to postal regulations with both sides of the stock being printed, perforated on press to enable tear-off of the reply or return order portion of the self-mailer, scored to enable folding, provided with a die cut mailing window, and delivered as a continuous form for subsequent application of an individual's name and address by laser printing.

Also in accordance with the present invention there is provided a printed paper product such as a self-mailer on which the name and address of an individual is applied by printing with a digital imager or by laser imaging from a rotated font which enables maximum usage of the full width of a continuous form laser printer.

The printed paper product of the invention in its final form will look like a window envelope with recipient's name and address showing through the window. This name and address is laser printed onto the back of the reply or return order envelope so that the advertiser has a complete record of the source of the order.

The printed paper product of the invention provides a large area for promotion, an area for an order form, and a postage paid return envelope for providing payment with the order all in one efficient package. Thus the product provides the functions of a separate sales letter, a separate order form, a separate business reply envelope, and a carrier envelope for the entire package. In addition, the product is personalized.

Again in accordance with the present invention there is provided a method of manufacture of a printed paper product such as a self-mailer on which the name and address of an individual or any other printed matter is applied by laser imaging.

It is an object of the present invention to manufacture a printed paper product such as a self-mailer with a return order envelope.

It is another object of the present invention to manufacture printed paper products such as self-mailers on which the name and address of an individual is applied by printing with a digital imager or by laser imaging from a rotated font which enables maximum usage of the full width of a continuous form laser printer.

These and other objects of the invention will be more apparent from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like references indicate similar parts and in which.

DESCRIPTION OF THE PREFERRED EMBODIMENTS

Figure 1:
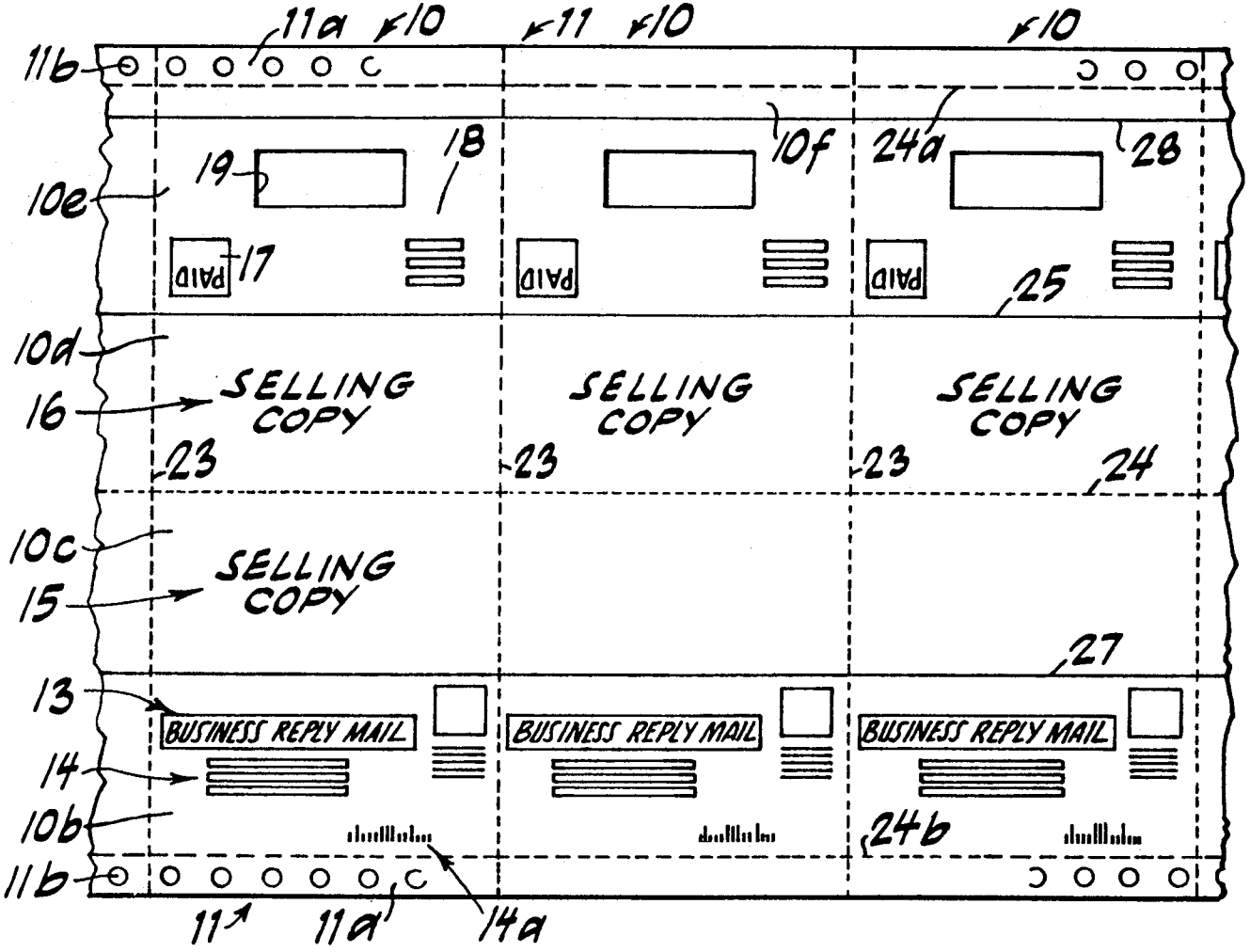
FIG. 1 is a layout view of the front side of the continuous format of a single unfolded self-mailer of the invention on a forms press with the major dimension of the self-mailer extending laterally across the forms press.

As shown in FIG. 1, a sheet-like paper product such as self-mailer 10, a reply self-mailer, is manufactured by printing applied to both sides of the stock or web 11 as it is advanced. The printing can be in one to four or more colors. The format is printed on a continuous forms press on stock meeting postal regulations for thickness and weight for self-mailers.

The format of self-mailer 10 extends across the laser printer which can process paper 16" or 18" in width. Therefore, the flat size of the self-mailer is either 16" high (including carrying strip 11*a* with line holes 11*b* at the bottom and top of the form as viewed in FIG. 1 by an equally divisible cutoff of the forms press (5½", 7 ⅓", 8 ½", etc.) or 18" high (including carrying strips 11*a* and line holes 11*b* at the top and bottom of the form, respectively) if a larger laser printer is being used. The sizes after the line holes 11*a* and 11*b* are slit off are 15" or 17" respectively.

As shown in FIG. 1, on the front side of a first panel 10*b* of self-mailer 10 there is printed in location 13 the notation "BUSINESS REPLY MAIL" and in location 14, the notation "SENDER'S NAME and ADDRESS". At the front side of a second panel 10*c*, there is shown in location 15, the notation "SELLING COPY". On the front side of a third panel 10*d* there is shown in location 16, the notation "SELLING COPY".

Figure 3:
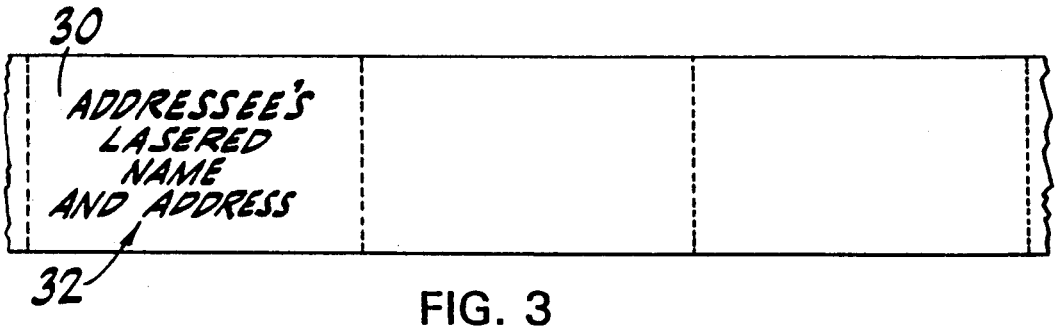
FIG. 3 is a layout view of panels which form envelope pockets by collating and gluing to the self-mailer.

On the fourth panel 10*e* in location 17, there is shown the notation of "PAID" for the sender's postage. On the front side of panel 10*e*, there is shown in location 18, the address of the sender. Die-cut window 19 is provided in fourth panel 10*e* to expose the "ADDRESSEE'S LASERED NAME AND ADDRESS" on the front side panel 30 at location 32 as shown in FIG. 3.

Figure 2:
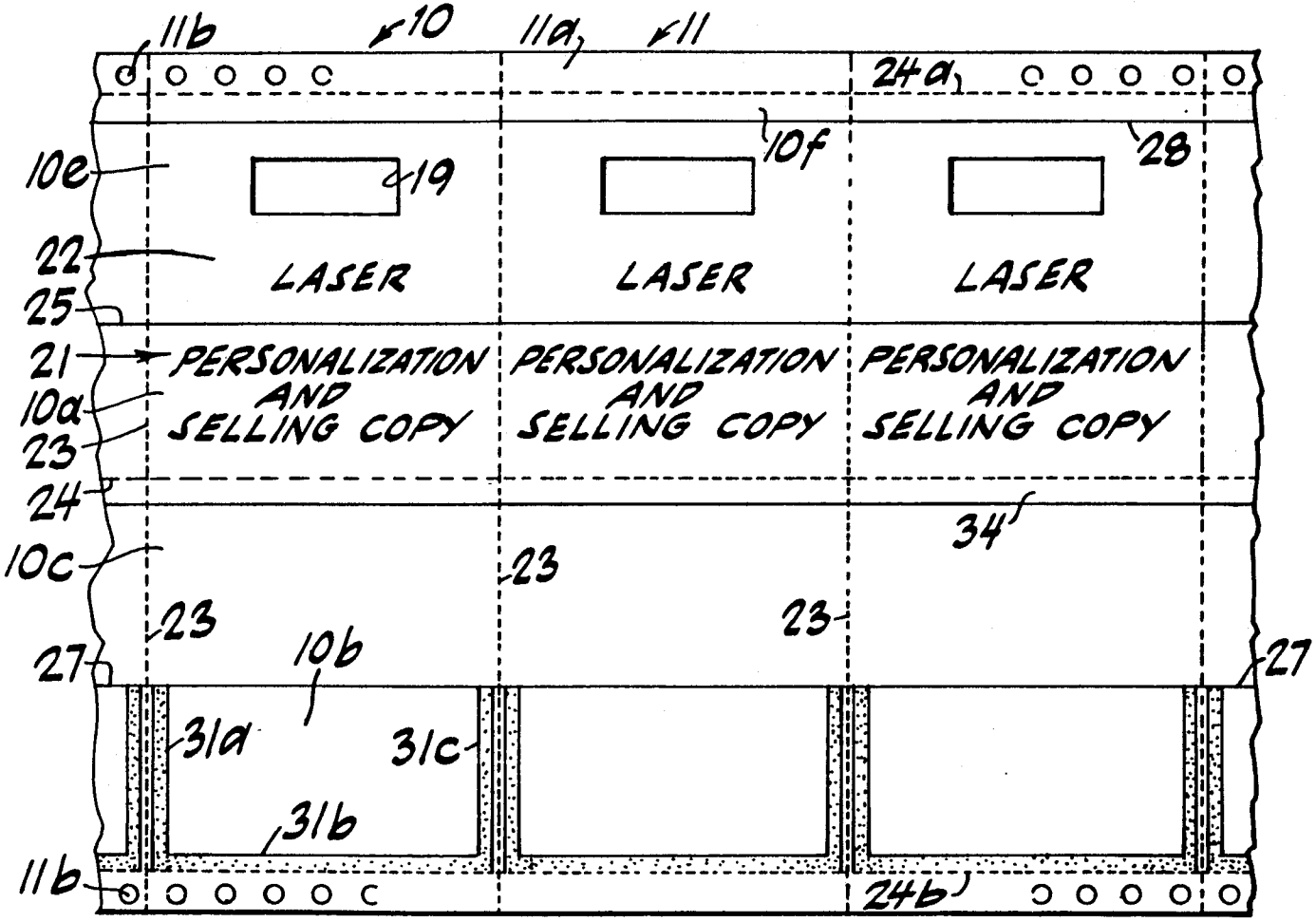
FIG. 2 is a layout view of the reverse side of the continuous format of a single unfolded self-mailer of the invention on a forms press with the major dimension of the self-mailer extending laterally across the forms press.

The reverse side of the self-mailer 10 is shown in FIG. 2. On the reverse side of panel 10*b* there is applied a U-shaped glue pattern 31*a*, 31*b*, and 31*c* respectively, the reverse side of panel 10*c* can be blank or printed.

After the stock or web 11 is provided with lateral perforations 23 and longitudinal perforations 24, 24*a* and 24*b*, score lines 25, 27 and 28, laser personalization in locations 21 and 22 on the reverse side of panels 10*d* and 10*e*, respectively, can be applied, i.e., laser printing of the name of the party to whom self-mailer 10 is to be sent. The reverse side of panels 10*d* and 10*e* may also contain selling copy.

Figure 4:
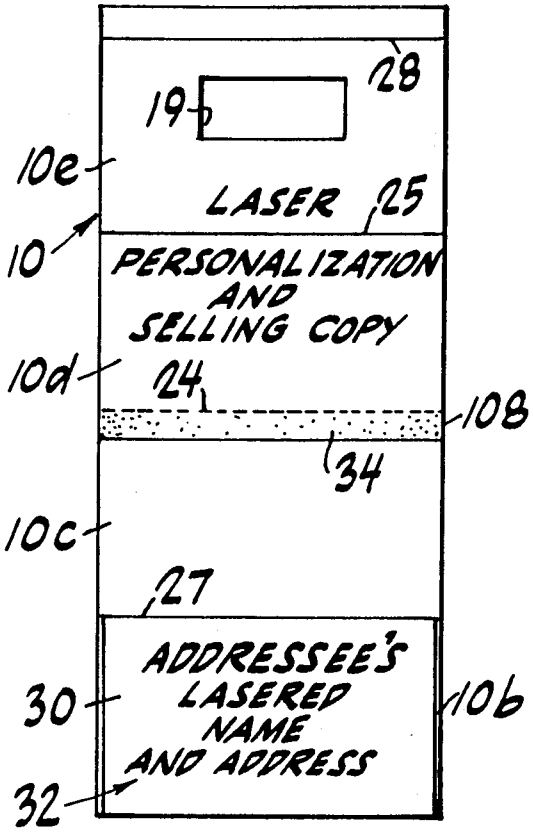
FIG. 4 is a layout view of the reverse side of the completed mailer of the invention shown in FIGS. 1 and 2.

In FIG. 4, there is shown the reverse side of additional panel 30 which is collated or plow-folded and glued over panel 10*b* of the self-mailer 10 to U-shaped glue pattern 31*a*, 31*b*, and 31*c* (FIG. 2) applied to the reverse side of panel 10*b*. As shown in FIG. 4 the lateral width of panel 30 with respect to the longitudinal dimension of web 11 is slightly less than one-quarter the total width of the self-mailer including panels 10*b*–10*e*. Panel 30 when glued to panel 10*b* forms an envelope pocket with the opening of the pocket adjacent score line 27. The reverse side of panel 30 as shown in FIG. 3 bears at location 22 the "ADDRESSEE'S LASERED NAME AND ADDRESS" and additional notation as may be desired. The printing can be laser printing.

As shown in FIG. 2, scoreline 28 defines flap 10*f* of panel 10*e*. Glue is applied on the flap during the folding of the flap. Thus flap 10*f* is glued to close and seal the self-mailer 10 when it is prepared by the sender for mailing.

Figure 5:
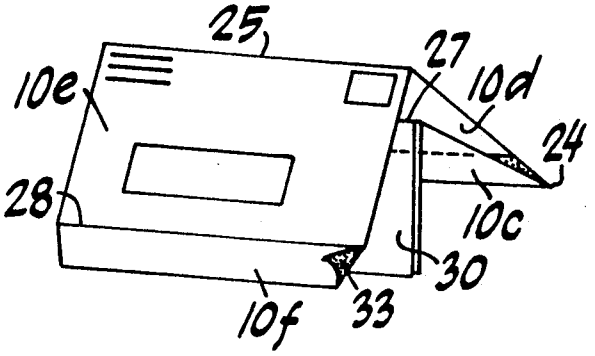
FIG. 5 is a perspective view showing the initial folding of the self-mailer of FIG. 4.
Figure 6:
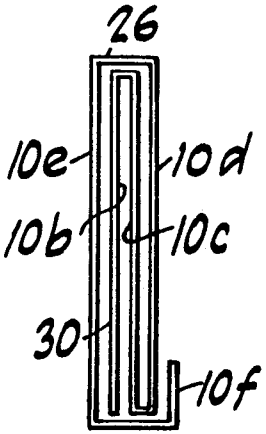
FIG. 6 is an end elevation view of the self-mailer of the invention of FIGS. 1 and 2 in the final flat-folded and glued form prior to mailing.

The self-mailer 10 in its final form being made ready for mailing as shown in FIGS. 5 and 6 looks like a window envelope with the addressee's name and address on panel 30 showing through the window 19. The name and address is laser printed onto the back of the reply envelope comprising panels 10*c* and 10*b* with panel 30 glued thereto in order that the advertiser has a complete record of the source of the order.

In FIG. 4, panel 30 bearing the particulars of the addressee's name and address is shown glued in place over the reverse side of panel 10*b*. There is also shown remoistenable glue pattern 34 which is adapted to seal the return envelope which comprises panels 10*c* and 10*b* with panel 30 glued thereto. The return envelope is separated by the addressee along perforation 24.

If the laser printing of the addressee "reads right", the flap 10*f* of the self-mailer 10 is on the bottom of the self-mailer as shown in FIG. 5. Should there be a desire for the flap 10*f* to be at the top of the self-mailer, then the addressee's name and address on the back portion of panel 30 would be placed "upside down" with respect to the rest of the copy. Alternatively, to avoid the "upside down" look, all copy visible on the reverse side of the self-mailer can be selected to read with the "upside down" addressee's name and address.

Figure 7:
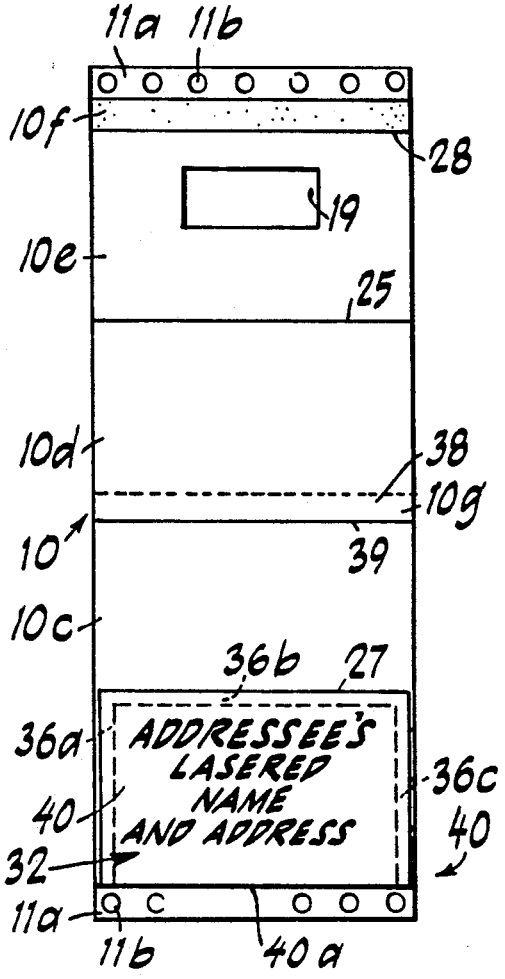
FIG. 7 is a layout view of the opposite side of another embodiment of the invention in which the flap of the return envelope is at the bottom of the envelope.

As an alternative to the opening of the reply envelope pocket at the top thereof as shown in FIGS. 4–6, the opening of the reply envelope pocket formed by panel 30 can be constructed to fall next to the carrying strip 11*a* at the bottom portion 40*a* of panel 40 as shown in FIG. 7. This can be done by inverting the "U" shaped glue pattern 36*a*, 36*b* and 36*c* on panel 10*b* which forms one side of the return envelope pocket and by changing the construction of the flap 10*g* with score line 39 and perforation 40 as shown in FIG. 7 which is provided with glue 38 to seal the reply envelope closed. The pocket would be sealed on all four sides (because of the collation glue in the carrying strip area) but would be slit open during the bursting operation.

To return the reply envelope, the addressee separates panel 10*d* from flap 10*g* along perforation 41. After panel 10*c* is folded about score line 27, flap 10*g* is folded about score line 39 to bring glue 38 into contact with the lower edge of the front side of panel 10*b* shown in FIG. 1. Since bar code 14*a* shown in FIG. 1 would be covered by flap 10*g*, the bar code 14*a* can be applied to the front side of flap 10*g* opposite the reverse side bearing glue 38 as shown in FIG. 7.

Figure 8:
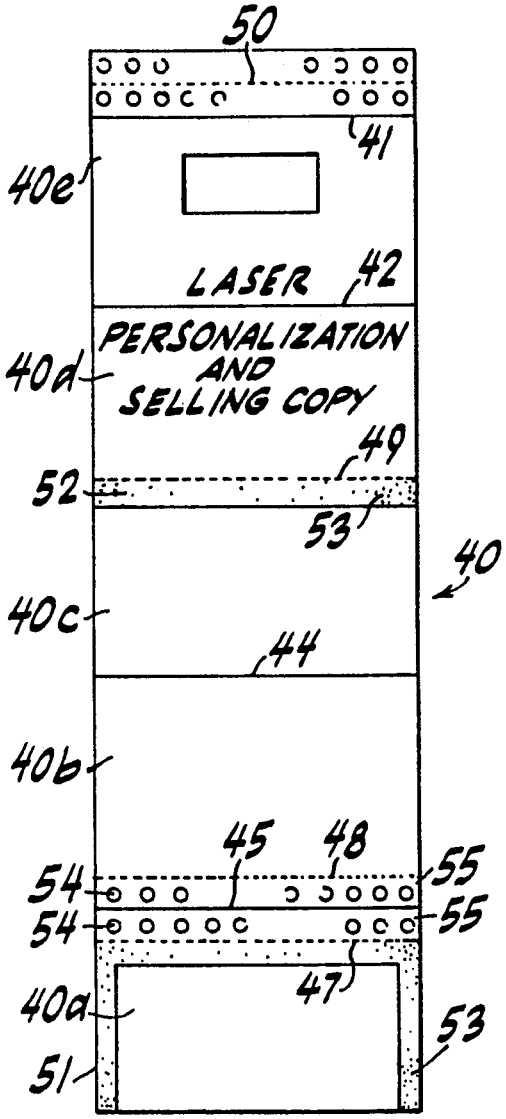
FIG. 8 is a layout view of the reverse side of another embodiment of the invention in which the return envelope is formed by plow folding a panel to form the pocket of the envelope.

In FIG. 8, there is shown the reverse side of reply self-mailer 40 having pocket panel 40*a* and panels 40*b*, 40*c*, 40*d* and 40*e*. Self-mailer 40 is provided with score lines 41–45 and perforations 47, 48, 49 and 50. An inverted U-shaped pattern 51 of adhesive is applied to the reverse side of panel 40*a*. An elongated pattern 52 of adhesive is applied in location 53 on the reverse side of panel 40*c*.

The reply self-mailer 40 with pocket panel 40*a* can be processed on a wider press such as a 24" wide (or wider) press with a plow folder. Thus instead of a separate panel 30 bearing the ADDRESSEE'S LASERED NAME AND ADDRESS as shown in FIG. 3, the front side (not shown) of panel 40*a* in FIG. 8 bears the ADDRESSEE'S LASERED NAME AND ADDRESS. By plow folding about score line 45 extending between carrying strips 55 and line holes 54, the reverse side of panel 40*a* can be adhered to the reverse side of panel 40*b* by glue pattern 51, thereby forming a pocket for the reply envelope. The opening of the pocket is adjacent score line 44. The addressee can separate the reply envelope of panels 40*a*, 40*b*, and 40*c* from panel 40*d* by detaching along perforation 49. The addressee then can close the reply envelope and the pocket therein by folding the reverse side of panel 40*c* about score line 44 to adhere glue line 53 to the front side of panel 40*b*.

During the bursting and slitting operation, the strips 55 bearing line holes 54 can be removed. The reply self-mailer 40 can then be processed as with self-mailer 10 shown in FIGS. 1 and 2.

The invention provides a large area for promotion, an area for an order form and a postage paid envelope for providing payment with the order, all in one efficient package. Thus self-mailers 10 and 40 do the work of a separate sales letter, a separate order form, a separate business reply envelope and a carrier envelope for the entire package. In addition, it is personalized.

As shown in FIGS. 1 and 2 the basic form of self-mailer is printed with a die-cut mailing window, a perforation 24 running parallel to the direction of the web 11 of paper and with a strip 34 of remoistenable glue running adjacent to and parallel to the perforation. This is done on a standard continuous forms press and rewound into rolls ready for collating. Similarly, the envelope pocket on panel 30 is delivered, rewound, printed or unprinted, to the collator which marries the two together and delivers them as a zig-zag folded continuous two-part form. From here the forms go to the laser printer for personalization and addressing. The final steps are to slit off the carrying strips 11, burst to single pieces, and folding three times with the last short fold glued on the folding machine to seal the self-mailer shut.

Since the forms have two levels of paper at the left, and only one level of paper at the right, provision must be made for the buildup of one side against the other. This can be done by providing wedges to build up the low side and by packing fewer forms per carton to minimize this difference in pile height. Wedges made of STYROFOAM resin material have proved satisfactory.

The advantages of the present invention, as well as certain changes and modifications of the disclosed embodiments thereof, will be readily apparent to those skilled in the art. It is the applicant's intention to cover by his claims all those changes and modifications which could be made to the embodiments of the invention herein chosen for the purpose of the disclosure without departing from the spirit and scope of the invention.

What is claimed is:

1. In a printed paper rectangular self-mailer having four panels including a first panel having a front side having the particulars of the sender and postage thereon, a second panel connected by a score line to the first panel, the front side of the second panel having the sender's selling copy thereon, the reverse side of a third panel being connected by a perforation to the second panel and having selling copy on the front side thereof, and a fourth panel connected by a score line to the third panel and having a mailing window and postage and the sender's address on the front side thereof, a flap extending along a score line at the edge portion of the fourth panel disposed opposite to the score line thereof connecting the fourth panel to the third panel, the reverse side of the fourth panel having a personalized message to the addressee thereon, the improvement comprising an additional panel separate from the self-mailer for receiving thereon the particulars of the addressee on a side thereof, the reverse side of the additional panel being glued to the reverse side of the first panel to form the pocket of a return envelope, the self-mailer being placed in a folded position in which the reverse side of the second panel and the front side of the additional panel glued to the reverse side of the first panel overlie the reverse side of the third and fourth panels, respectively, with the window in the fourth panel disposed over the side of the additional panel for receiving the particulars of the addressee, the folded first and third panels and the folded second and fourth panels being folded with the front side of the first panel contiguous with the front side of the second panel, and the flap of the fourth panel being folded about the score line thereof and glued to the portion of the front side of the third panel adjacent to the score line between the second and third panels, the second panel being separable by the addressee along the perforation connecting the second panel to the third panel, the additional panel forming the envelope pocket when folded against the reverse side of the second panel and thereby forming the return envelope with the sender's particulars and postage exposed on the front side of the first panel.

2. A self-mailer in accordance with claim 1 in which the reverse side of the additional panel is collated upon and glued to the reverse side of the first panel.

3. A self-mailer in accordance with claim 1 in which the additional panel is connected to the first panel at the edge portion thereof disposed opposite the score line between the first and second panels, the additional panel being plow folded against the reverse side of the first panel to form the envelope pocket of the return envelope.

4. A self-mailer in accordance with claim 3 in which the additional panel is connected by a pair of carrying strips to the first panel, the pair of carrying strips having a score line extending therebetween, the additional panel being plow folded about the score line against the reverse side of the first panel to form the envelope pocket of the return envelope.

5. A self-mailer in accordance with claim 1 in which the reverse side of the second panel adjacent to the edge portion thereof disposed opposite to the first panel has a glue strip extending parallel to the score line connecting the second panel to the first panel, the glue strip adhering the reverse side of the second panel to the front side of the additional panel to close the return envelope for mailing thereof by the addressee.

6. A self-mailer in accordance with claim 1 in which glue is disposed adjacent one of the edge portions of the reverse side of the first panel disposed opposite to the score line between the first and second panels and adjacent the edge portions of the reverse side of the first panel extending from the score line thereof.

7. A self-mailer in accordance with claim 1 in which glue is disposed adjacent the edge portion of the reverse side of the first panel disposed opposite to the score line between the first and second panels and adjacent the edge portions of the reverse side of the first panel extending from the score line thereof.

8. A self-mailer in accordance with claim 1 in which a flap is connected to the edge portion of the second panel disposed opposite to the score line between the first and second panels, the flap extending to the perforation connecting the third panel to the second panel, glue being disposed on the reverse side of the flap, the reverse side of the flap being folded about its score line to be contiguous to the first side of the first panel to enable the glue to close the envelope pocket and envelope for return mailing by the addressee.

9. A self-mailer in accordance with claim 8 in which the front side of the flap contains a portion of the particulars of the sender on the front side of the first panel.

10. A self-mailer in accordance with claim 6 in which glue is disposed adjacent one of the edge portions of the reverse side of the first panel disposed adjacent to the score line between the first and second panels and adjacent the edge portions of the reverse side of the first panel extending from the score line thereof.

11. A self-mailer in accordance with claim 8 in which glue is disposed adjacent the edge portion of the reverse side of the first panel disposed opposite to the score line between the first and second panels and adjacent the edge portions of the reverse side of the first panel extending from the score line thereof.

12. A method for producing a printed paper rectangular self-mailer having four panels including a first panel having a front side for receiving thereon the particulars of the sender and postage thereon, a second panel connected by a score line to the first panel, the front side of the second panel having the sender's selling copy thereon, the reverse side of a third panel being connected by a perforation to the second panel and having selling copy on the front side thereof, and a fourth panel connected by a score line to the third panel and having a mailing window and postage and the sender's address on the front side thereof, a flap extending along a score line at the edge portion of the fourth panel disposed opposite to the score line thereof, connecting the fourth panel to the third panel, the reverse side of the fourth panel having a personalized message to the addressee thereon, the improvement comprising the providing of an additional panel separate from the self-mailer for receiving the particulars of the addressee on the front side thereof, attaching the additional panel to the reverse side of the first panel to form the pocket of a return envelope, placing the self-mailer in a folded position in which the reverse side of the second panel and the additional panel attached to the reverse side of the first panel overlie the reverse side of the third and fourth panels, respectively, with the window in the fourth panel disposed over the particulars of the addressee on the additional panel, folding the folded first and third panels and the folded second and fourth panels with the front side of the first panel contiguous with the front side of the second panel, and folding the flap of the fourth panel about the score line thereof and attaching the flap to the portion of the front side of the third panel adjacent to the score line between the second and third panels, the second panel being separable by the addressee along the perforation connecting the second panel to the third panel, the additional panel forming the envelope pocket when folded against the reverse side of the second panel forming the return envelope with the sender's particulars and postage exposed on the front side of the first panel.

13. A method in accordance with claim 12 comprising collating the additional panel separate from the self-mailer with the particulars of the addressee on the front side thereof to place the reverse side of the additional panel on the reverse side of the first panel to form the pocket of a return envelope, and attaching the reverse side of the additional panel to the reverse side of the first panel.

14. A method in accordance with claim 12 in which the additional panel is connected to the first panel at the edge portion thereof disposed opposite the score line between the first and second panels, the additional panel being plow folded and glued against the reverse side of the first panel to form the envelope pocket of the return envelope.

15. A method in accordance with claim 14 in which the additional panel is connected by a pair of carrying strips to the first panel, the pair of carrying strips having a score line extending therebetween, the additional panel being plow folded about the score line and glued against the reverse side of the first panel to form the envelope pocket of the return envelope.

16. A method in accordance with claim 12 in which the attaching of the reverse side of the additional panel to form the pocket of a return envelope comprises attaching the additional panel to the reverse side of the first panel adjacent the edge portion of the first panel disposed opposite to the score line thereof and adjacent each of the edge portions of the first panel extending from the score line.

17. A method in accordance with claim 12 and further comprising providing a flap to connect the edge portion of the second panel disposed opposite to the score line between the first and second panels, the flap extending to the perforation connecting the third panel to the second panel, providing adhesive on the reverse side of the flap, the reverse side of the flap being folded about its score line to be contiguous to the first side of the first panel to enable the glue to close the envelope pocket and envelope for return mailing by the addressee.

18. A method in accordance with claim 17 and further comprising the providing on the front side of the flap a portion of the particulars of the sender on the front side of the first panel.

* * * * *